US007228798B2

(12) United States Patent
Göttling et al.

(10) Patent No.: US 7,228,798 B2
(45) Date of Patent: Jun. 12, 2007

(54) PRINTING MACHINE

(75) Inventors: Josef Göttling, Friedberg (DE); Godber Petersen, Augsburg (DE); Thomas Hartmann, Mering (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 4 days.

(21) Appl. No.: 11/121,733

(22) Filed: May 3, 2005

(65) Prior Publication Data

US 2005/0263023 A1 Dec. 1, 2005

(30) Foreign Application Priority Data

May 5, 2004 (DE) ..... 10 2004 022 086

(51) Int. Cl.
*B41F 3/18* (2006.01)

(52) U.S. Cl. ..... 101/171; 101/135

(58) Field of Classification Search ..... None
See application file for complete search history.

(56) References Cited

U.S. PATENT DOCUMENTS

| | | | | |
|---|---|---|---|---|
| 4,586,434 | A * | 5/1986 | Tokuno et al. | 101/178 |
| 4,616,564 | A * | 10/1986 | Faddis et al. | 101/143 |
| 4,711,172 | A * | 12/1987 | Capdebosc | 101/152 |
| 4,854,231 | A * | 8/1989 | Jahn | 101/177 |
| 5,549,044 | A | 8/1996 | Achelpohl | |
| 6,082,257 | A | 7/2000 | Secor | |
| 6,401,608 | B1 * | 6/2002 | Lyon et al. | 101/136 |
| 6,675,707 | B1 * | 1/2004 | Heiler et al. | 101/216 |
| 2005/0139109 | A1 * | 6/2005 | Plasswich et al. | 101/477 |

FOREIGN PATENT DOCUMENTS

| | | | |
|---|---|---|---|
| DE | 4309658 | C1 | 10/1994 |
| DE | 4344090 | A1 | 6/1995 |
| DE | 29822104 | U1 | 2/1999 |
| DE | 19962425 | B4 | 7/2001 |
| DE | 10050750 | A1 | 4/2002 |
| DE | 10112522 | A1 | 9/2002 |
| DE | 10261999 | A1 | 2/2004 |
| EP | 1110 721 | A1 | 6/2001 |

OTHER PUBLICATIONS

German search report for German Patent Application No. 10 2004 022 086.7.

European search report in counterclaim European Patent Application No. 05009567.8.

* cited by examiner

*Primary Examiner*—Daniel J. Colilla
*Assistant Examiner*—Jill E. Culler
(74) *Attorney, Agent, or Firm*—Leydig, Voit & Mayer, Ltd.

(57) ABSTRACT

A web-fed printing machine is provided. The printing machine includes a plurality of printing units. A first work station precedes the printing units. A second work station follows the printing units. At least one lifting device is assigned to the printing units for transporting printing unit modules. The lifting device is movably mounted on a top side of the printing units.

3 Claims, 15 Drawing Sheets

PRINTING MACHINE

FIELD OF THE INVENTION

The invention relates to a printing machine and, in particular, to a web-fed printing machine.

BACKGROUND OF THE INVENTION

In printing operations, what are referred to as printing sleeves are typically positioned on impression cylinders of a printing machine in order to enable a smooth and jolt-free rolling of the cylinders of a printing machine that are involved in printing. With printing machines of variable format, two printing sleeves are positioned one above the other on the impression cylinders. An outer printing sleeve forms a printing surface and an inner printing sleeve serves for diameter compensation between the outer printing sleeve and the respective impression cylinder of the printing machine. In such cases, the outer printing sleeve typically has a small wall thickness, whereas the inner printing sleeve usually has a larger wall thickness, depending on the difference in diameter between the respective impression cylinder and the outer printing sleeve.

To carry out a production change between two different printing orders, it has been necessary to change at least the outer printing sleeve forming the printing surface. In the event of a production change between two printing orders which are characterized by the same printing format, only the outer printing sleeve has to be changed. If, however, the two printing orders also differ from one another in terms of their printing format, then the inner printing sleeve has to be exchanged in addition to the outer printing sleeve.

In order to supply the printing-unit modules to the printing units of the printing machine, in particular the printing sleeves, that are required for a production change lifting appliances are used in the prior art that are positioned on a floor of a machine hall or workshop in the area of the printing machine or the printing units of the printing machine. These lifting appliances may be stationary or movable. What all these lifting appliances have in common, however, is that they obstruct or block up the room or space available at the printing units and consequently hinder conversion work on the printing units of the printing machine because access to the printing units is impeded. Furthermore, it is already known from the prior art to use a hall crane which is fastened to a ceiling of a workshop or machine hall for conversion work on printing machines. However, obviously, the use of a hall crane for conversion work on printing machines is possible only when the workshop is already equipped with this type of a hall crane.

BRIEF SUMMARY OF THE INVENTION

In view of the foregoing, a general object of the present invention is to provide a novel printing machine in which conversion work can be carried out without the need for the lifting appliances used in the prior art. The printing machine according to the invention includes at least one lifting device, assigned to the printing units, for transporting or changing of printing-unit modules, in particular of printing sleeves. Each lifting device is mounted displaceably and/or pivotably mounted on a top side of the printing machine or of the printing units.

According to a further aspect of the present invention, lifting devices which are used for the changing of printing-unit modules in the event of conversion work on the printing units of the printing machine can be fastened on a top side of the printing units of a printing machine. The lifting devices are displaceably and/or pivotably mounted on the top side of the printing units of the printing machine, so that the lifting devices can be moved relative to the printing units to any desired position in the space within a particular radius of action. Thus, with the printing machine according to the invention, the lifting devices of the prior art, which obstruct or block up the space near the printing units and consequently hinder the conversion work on the printing machine, can be eliminated.

According to a first advantageous embodiment of the invention, each lifting device has associated rails that are fastened on the top side of the printing units. A first frame of the lifting device is guided in the rails via rollers in such a way that the lifting device can be displaced in a first direction. A second frame is guided on the first frame in such a way that the lifting device is also displaceable in a second direction extending perpendicular to the first direction.

According to a second advantageous embodiment of the invention, a lifting device is fastened rotatably or pivotably via a centre of rotation on the top side of each printing unit. The lifting devices have telescopically movable jibs. An outer jib is rotatably mounted on a printing unit via the centre of rotation and inner jibs are nested one in the other and in the outer jib and movably guided via rollers.

According to a third advantageous embodiment of the invention, which comprises a combination of the first and second embodiments, rails for each lifting device are fastened on the top side of the printing units. A frame of the corresponding lifting device is guided in the rails via rollers in such a way that the lifting device can be displaced in one direction. The lifting devices having telescopically movable jibs. An outer jib is rotatably mounted on the frame via a centre of rotation and inner jibs are nested one in the other and movably guided via rollers.

BRIEF DESCRIPTION OF THE SEVERAL VIEWS OF THE DRAWING(S)

DETAILED DESCRIPTION OF THE INVENTION

Figure 1:
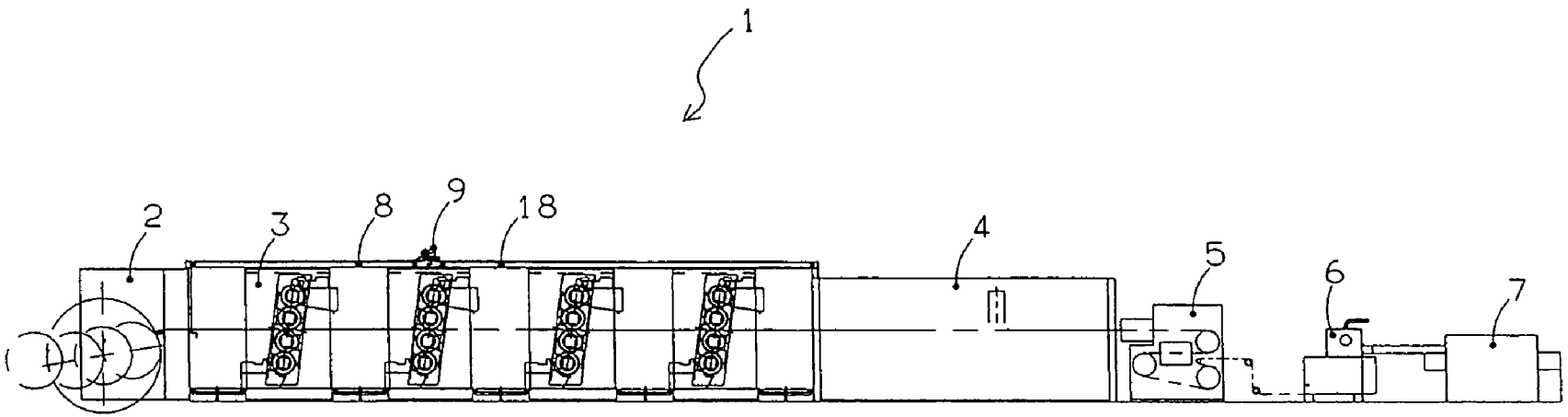
FIG. 1 is a side view of an exemplary printing machine according to the invention.

A first exemplary embodiment of a printing machine 1 according to the invention is shown in FIGS. 1–3, 5 and 7. The illustrated printing machine 1 is designed as a web-fed printing machine and includes a reel changer 2, a total of four printing units 3, a dryer 4, a cooling unit 5, a cutting unit 6 and a folding unit 7. In the four printing units 3, a print carrier is simultaneously printed on a top side and an underside. For example, a yellow, cyan, magenta or black process ink required for halftone printing together are applied to the print carrier in each of the four printing units 3. The reel changer 2 precedes the four printing units 3. In contrast, the dryer 4, the cooling unit 5, the cutting unit 6 and the folding unit 7 follow the four printing units 3.

According to the present invention, a printing machine is provided which includes at least one lifting device, assigned to the printing units 3, for the changing of printing-unit modules, in particular of printing sleeves. Each lifting device is displaceably and/or pivotably mounted on a top side 8 of the printing units 3. The lifting device of the illustrated embodiment of FIGS. 1, 2, 3, 5 and 7 is identified as a unit by the reference numeral 9. Rails 18 are fastened on the top side 8 of the printing units 3 of the printing machine 1. The lifting device 9 is guided in the rails 18 and is displaceable along the rails 18. The rails 18 extend at least over the region of all the printing units 3, that is to say at least between the reel changer 2 and the dryer 4. The lifting devices 9 guided in the rails 18 are therefore movable along the rails 18 over the region of all the printing units 3.

Figure 2:
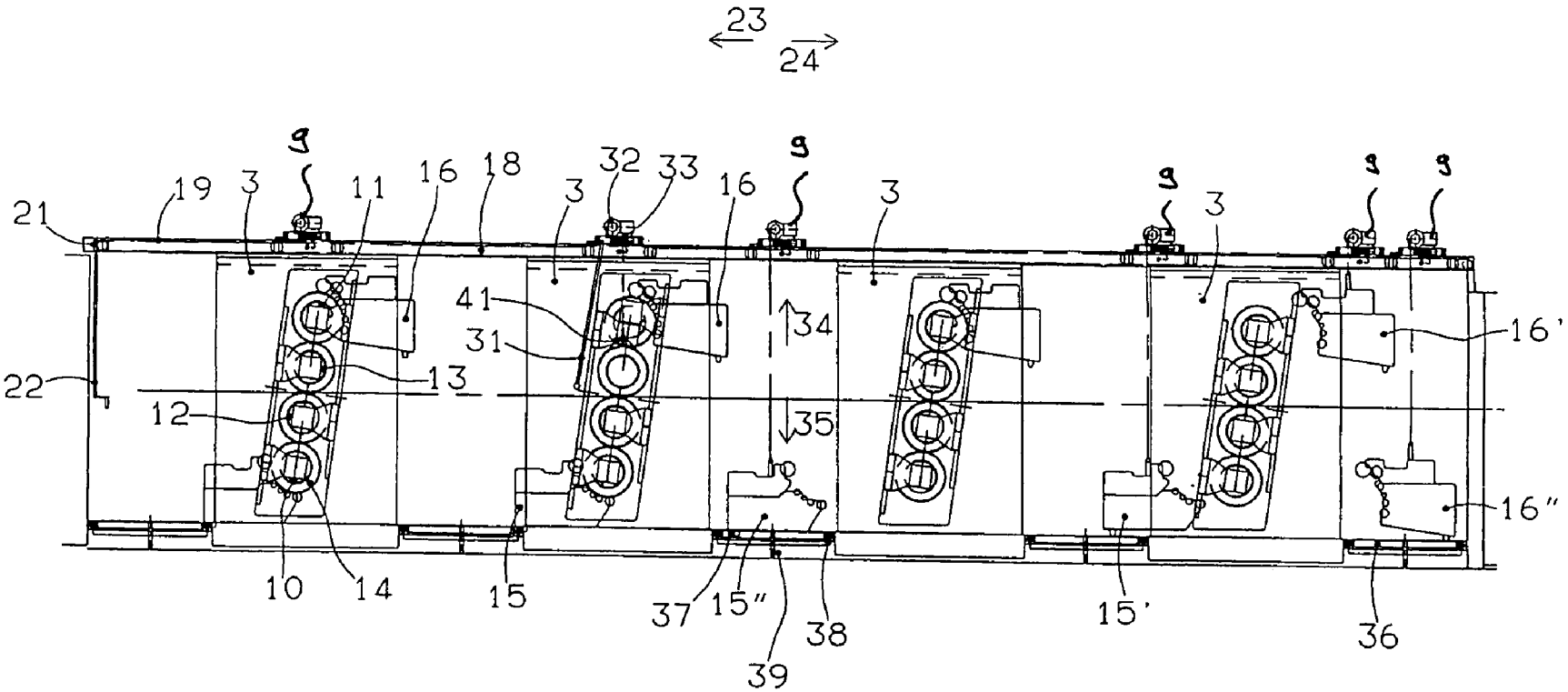
FIG. 2 is an enlarged side view of a portion of the printing machine of FIG. 1.

Before explaining the details of the lifting device 9 of the embodiment of FIGS. 1, 2, 3, 5 and 7, it should be noted that the lifting device 9 serves, inter alia, for the handling of printing sleeves 14. As shown in FIG. 2, two form cylinders 10 and 11 and two transfer cylinders 12 and 13 are positioned in the area of each printing unit 3. The form cylinder 10 cooperates with the transfer cylinder 12 and serves for printing the underside of the print carrier. The form cylinder 11 cooperates with the transfer cylinder 13 and serves for printing a top side of the print carrier. The printing sleeves 14 are preferably positioned on the form cylinders 10 and 11, preferably two printing sleeves 14 being positioned on each of the form cylinders 10 and 11 in the case of printing machines of variable format. An outer printing sleeve then forms a printing surface, and an inner printing sleeve serves for diameter compensation between the outer printing sleeve and the form cylinder 10 and 11. For carrying out maintenance work or conversion work, the printing sleeves 14 must be demounted from the form cylinders 10 and 11 and then moved away from the region of the printing units 3. The same also applies to the transfer cylinders 12, 13. Each lifting device 9 serves for this purpose.

Figure 3:
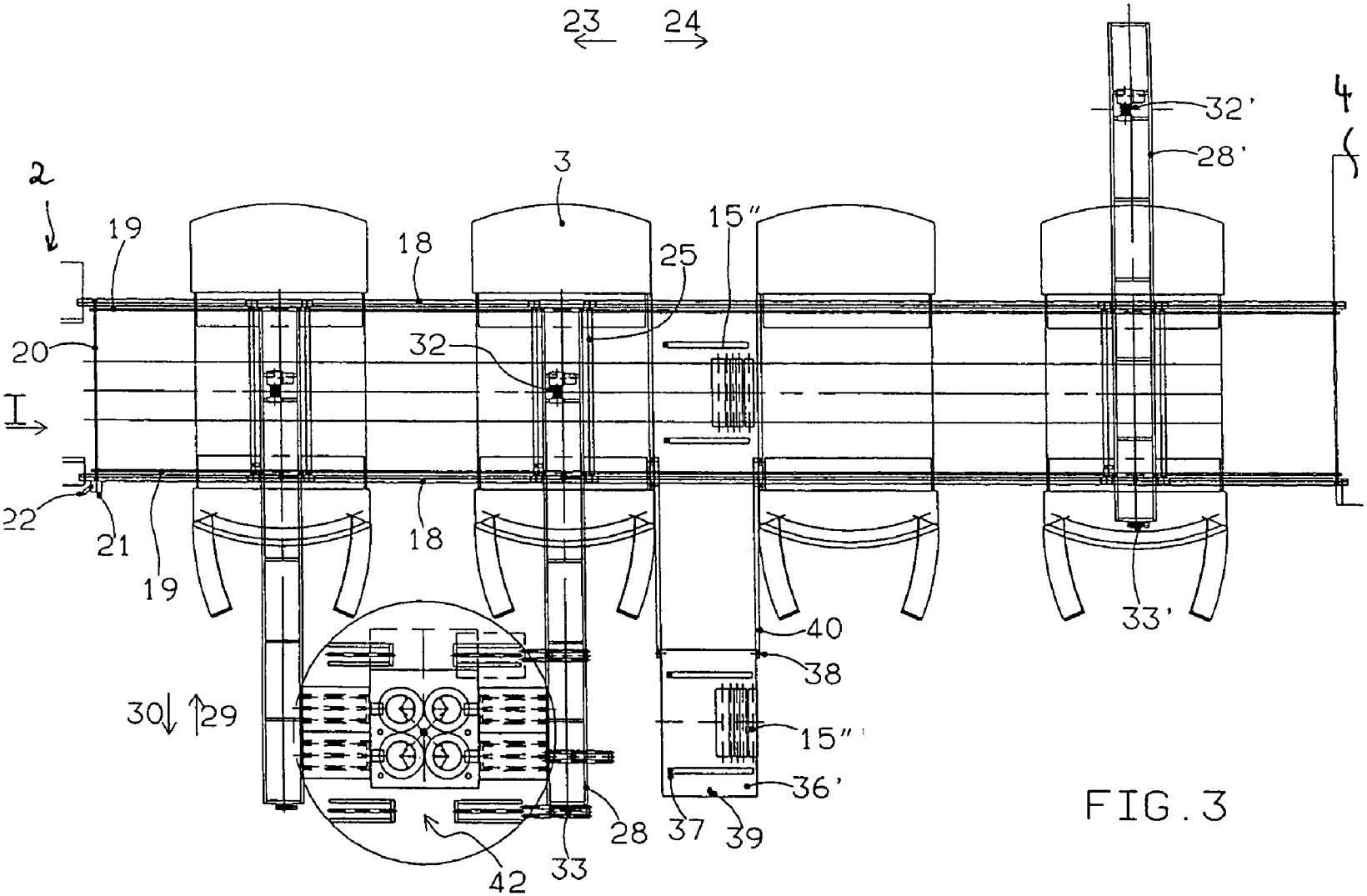
FIG. 3 is a top view of the portion of the printing machine of FIG. 1 shown in FIG. 2.

As shown in FIG. 3, each of the printing units 3 may be assigned two inking units 15 and 16. The inking units 15 and 16 can be moved into the positions identified by the reference numerals 15', 16', 15" and 16" for maintenance work or conversion work on the printing units 3 of the printing machine 1. Each lifting device 9 also serves for this purpose.

Figure 5:
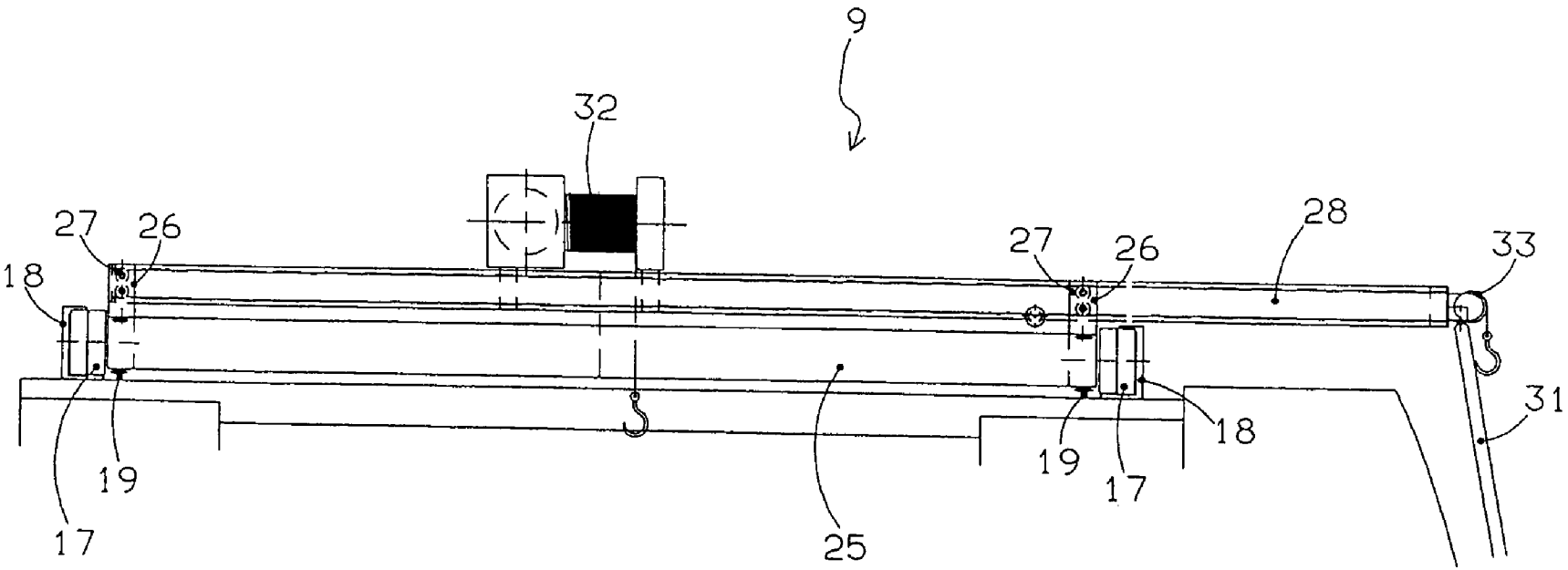
FIG. 5 is an enlarged view of the portion of the printing machine shown in FIGS. 2 and 3 taken in the viewing direction I of FIG. 3.

As already mentioned, the lifting devices 9 are mounted displaceably on the top side 8 of the printing units 3. For this purpose, rails 18 extend on the top side 8 of the printing units 3. As shown in FIG. 3, the rails extend over all the printing units 3 between the reel changer 2 and the dryer 4. The lifting device 9 of the exemplary embodiment of FIGS. 1, 2, 3, 5 and 7 has a first frame 25 which is displaceable via rollers 17 in the rails 18 in the directions of movement indicated by the arrows 23 and 24. The displacement of the frame 25 along the rails 18 takes place, for example, using toothed belts 19. As shown in FIG. 5, the toothed belts extend on the top side and the underside of the frame 25 and are deflected or guided at the ends of the rails 18 on transverse shafts 20 (see FIG. 3). A crank 22 engages on one of the transverse shafts 20 via a gear 21. Through the crank, the toothed belts 19 are ultimately driven and the frame 25 can be displaced in the direction of the arrows 23 and 24.

Figure 7:
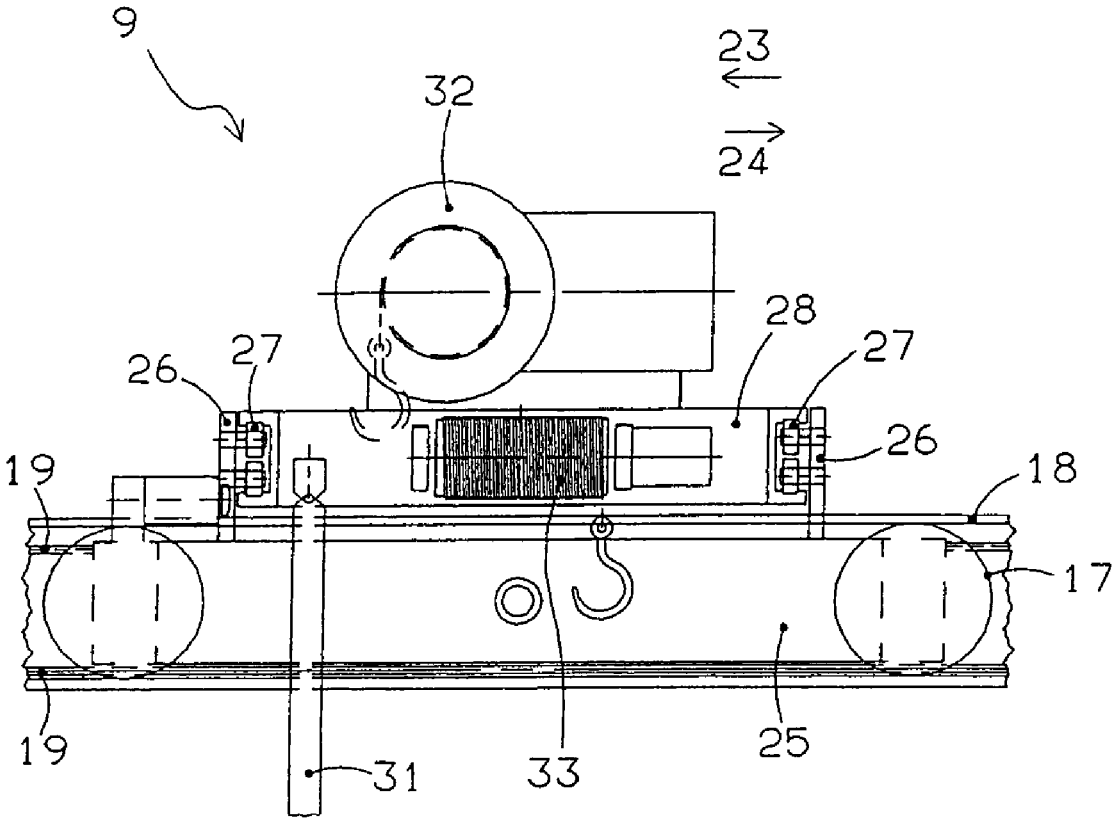
FIG. 7 is an enlarged view of a detail of the printing machine of FIG. 1.

As shown in FIGS. 5 and 7, supports 26 engage by means of rollers 27 on the first frame 25 of the lifting device 9. A second frame 28 of the lifting device 9 is guided on the supports 26 or rollers 27 in such a way that the lifting device 9 is displaceable in a second direction extending perpendicular to the first direction identified by the arrows 23 and 24. This second perpendicular direction is illustrated by the arrows 29 and 30 (see FIG. 3). The direction of movement 29, 30 runs transversely or perpendicular to the direction of movement 23, 24. A grip 31 (see FIG. 5), which is fastened to the second frame 28, serves for moving the second frame 28 in the direction of movement 29, 30. For reasons of clarity, the second frame 28 is somewhat shortened in FIG. 5, whereas it is shown in full size in FIG. 3.

As shown in FIGS. 5 and 7, two winches 32 and 33 are mounted or fastened on the second frame 28 of the lifting devices 9. With the aid of the larger winch 32, the inking units 15 and 16 can be moved in the direction of the arrows 34 and 35 (FIG. 2). Thus, the inking units 15 and 16 are suspended on the larger winch 32 in the positions identified by the reference numerals 15' and 16' and are lifted off from a base in the direction of the arrow 34. With the aid of the crank 22, the inking units 15 and 16 are then moved in the direction of the arrows 23 and 24 and brought according to the arrow 35 into the positions identified by the reference numerals 15" and 16'. In these positions, the inking units 15 and 16 can be deposited in an exact position on a platform 36 with the aid of guide pins 37. The platforms 36 are supported by rollers 38 on the printing units 3 and via rollers 39 on a floor of a workshop. This makes it easier to set up the platforms 36 horizontally, since only the rollers 39 have to be adjusted in relation to the floor. As illustrated in FIG. 3, the platforms 36 can be extended telescopically between the printing units 3 and can be brought, together with the inking units, into the position identified by the reference numeral 36' (see FIG. 3). The platforms 36 are movably supported on the printing units 3 via rails 40. Through a pushing-in movement, an inking unit 15 or 16 can be moved up to the printing unit 3 again in an exact position, and, in the position 15'", maintenance work can be carried out on the inking unit outside the printing machine.

Figure 14:
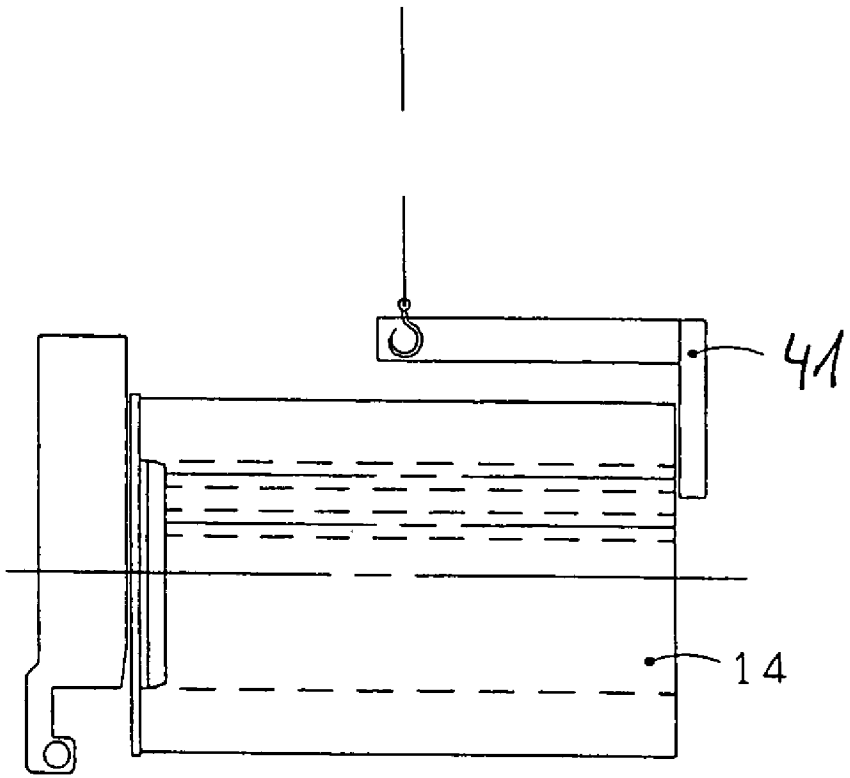
FIG. 14 is side view of a suspension device for printing sleeves according to the present invention.
Figure 15:
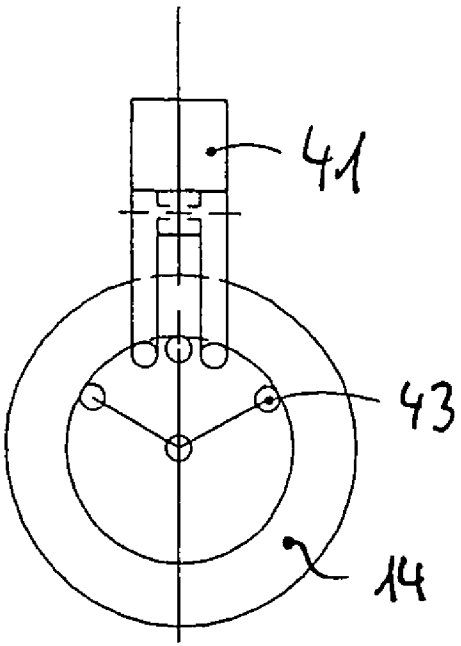
FIG. 15 is a front view of the suspension device of FIG. 14.

The second, smaller winch 33 serves for transporting the printing sleeves 14. A suspension device 41 or 44 (see FIGS. 14 to 18) is capable of being suspended in a hook of the winch 33 for this purpose. With the aid of the suspension device 41 or 44, the printing sleeves 14 can be extracted from a transport device 42 (see FIG. 3) for the printing sleeves and can then be moved in the direction of the printing units 3 of the printing machine. In the simplest case (see FIGS. 14 and 15), the suspension device 41 is designed as a fork-shaped element, with the aid of which the printing sleeve 14 can be extracted from a depository 43 of the transport device 42 in the horizontal orientation of the printing sleeves 14. As shown in FIG. 15, for this purpose, the fork-shaped suspension device 41 engages on an inner wall of the printing sleeve 14.

Figure 16:
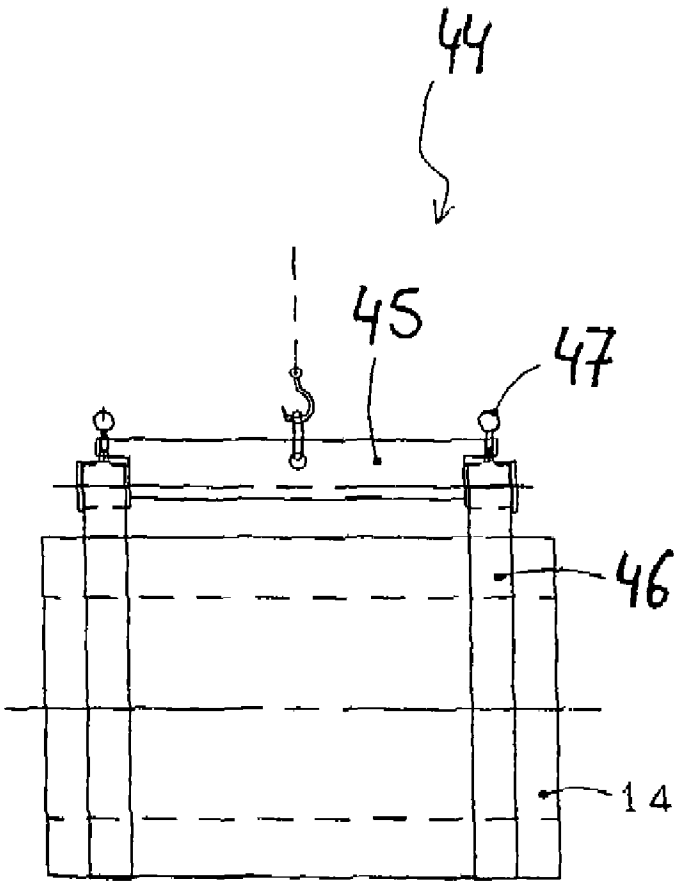
FIG. 16 is a side view of an alternative embodiment of a suspension device for printing sleeves according to the present invention.
Figure 17:
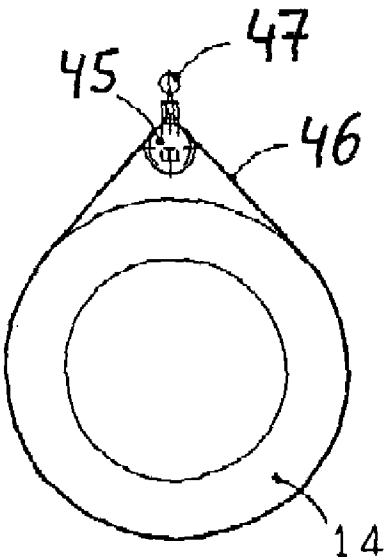
FIG. 17 is a front view of the suspension device of FIG. 16.
Figure 18:
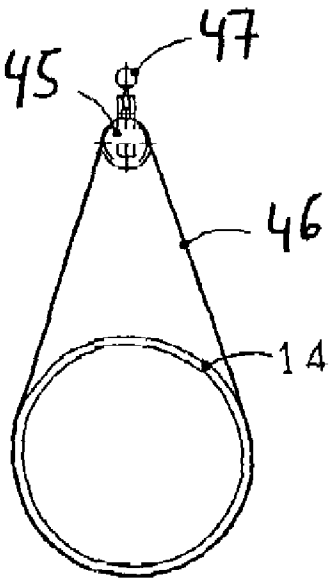
FIG. 18 is a front view of the suspension device of FIG. 16.

An alternative embodiment of a suspension device 44 is shown in FIGS. 16 to 18. The suspension device 44 according to FIGS. 16 to 18 has a beam 45. A loop 46 is suspended at each of the ends of the beam 45. The loops 46 are fixed via sprung pressure pins 47, so that the loops 46 can be exchanged in a simple way, but at the same time are secured against slipping out. As indicated from a comparison of FIGS. 17 and 18, printing sleeves of different diameter can be received and transported by means of the suspension device 44.

A second exemplary embodiment of a printing machine according to the invention is described below with reference to FIGS. 4, 6 and 8. In this exemplary embodiment, the printing units 3 of a printing machine are also assigned lifting devices 50 for the changing of printing-unit modules, in particular of printing sleeves 14. The lifting devices 50 are again mounted on a top side 8 of the printing units 3 of the printing machine. Only the differences from the exemplary embodiment of FIGS. 1, 2, 3, 5 and 7 are described below with regard to the exemplary embodiment of FIGS. 4, 6 and 8. To avoid unnecessary repetition, the same reference numerals are used for identical subassemblies.

Figure 4:
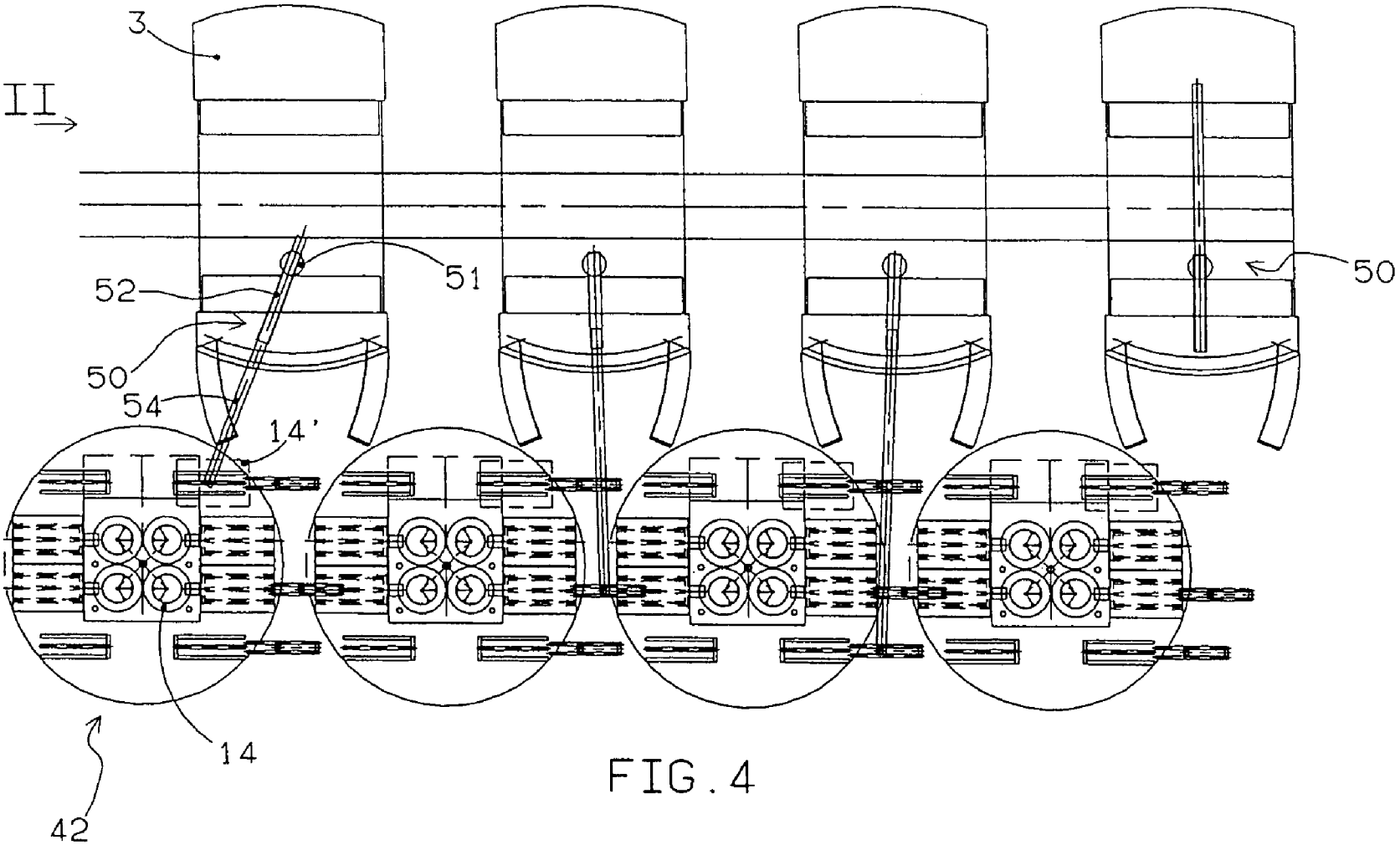
FIG. 4 is a top view similar to FIG. 3 of an alternative embodiment of a printing machine according to the invention according to a second exemplary embodiment of the invention.
Figure 6:
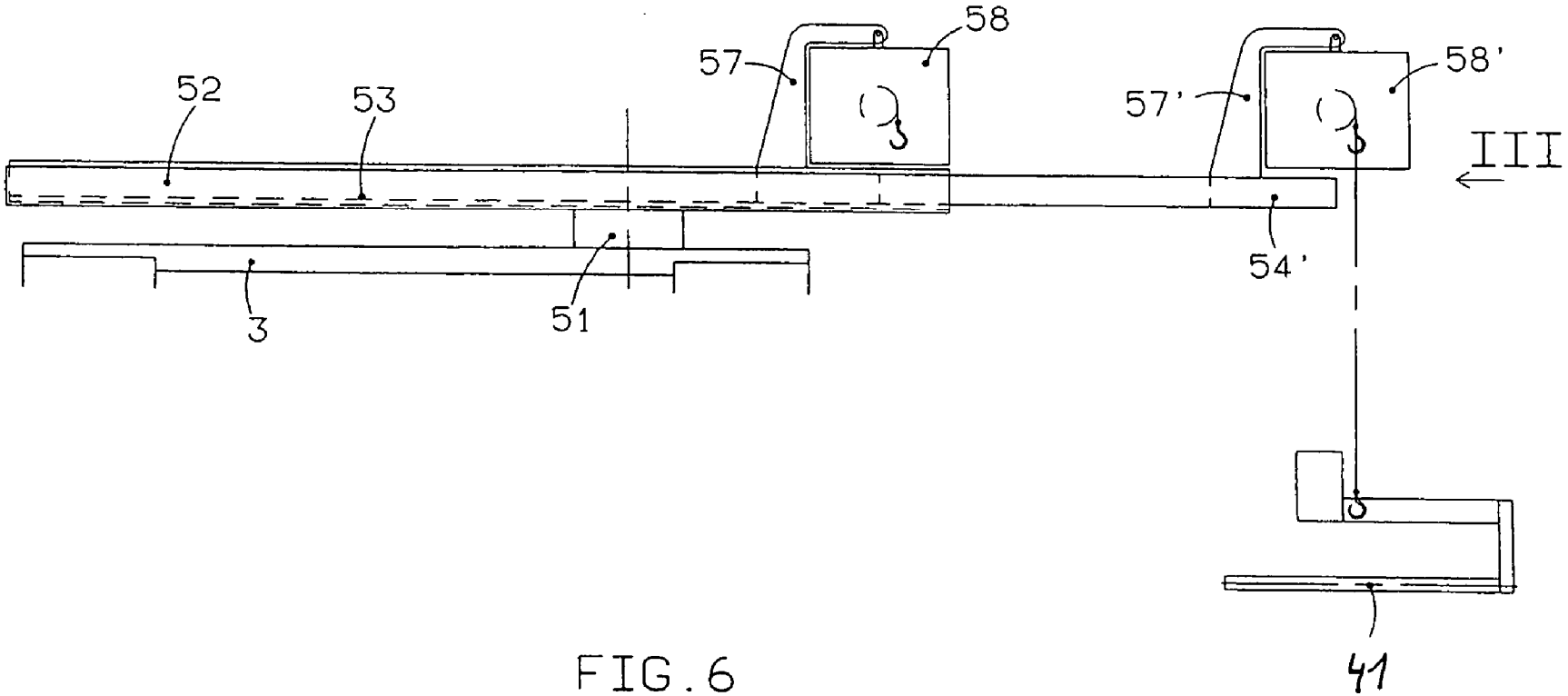
FIG. 6 is an enlarged view of the portion of the printing machine shown in FIG. 4 in the viewing direction II of FIG. 4.
Figure 8:
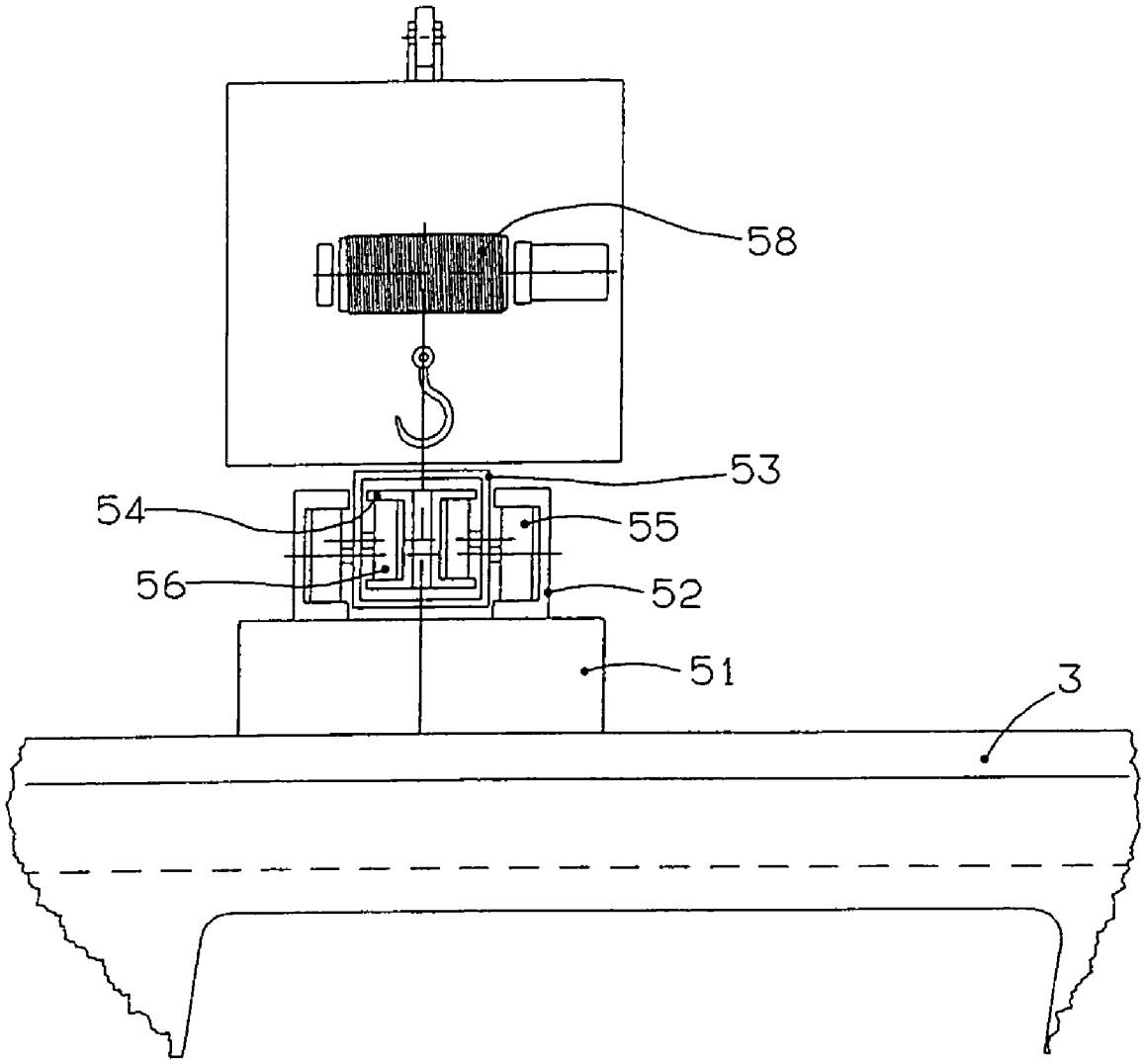
FIG. 8 is a view of the printing machine shown in FIG. 6 in the viewing direction III of FIG. 6.
Figure 9:
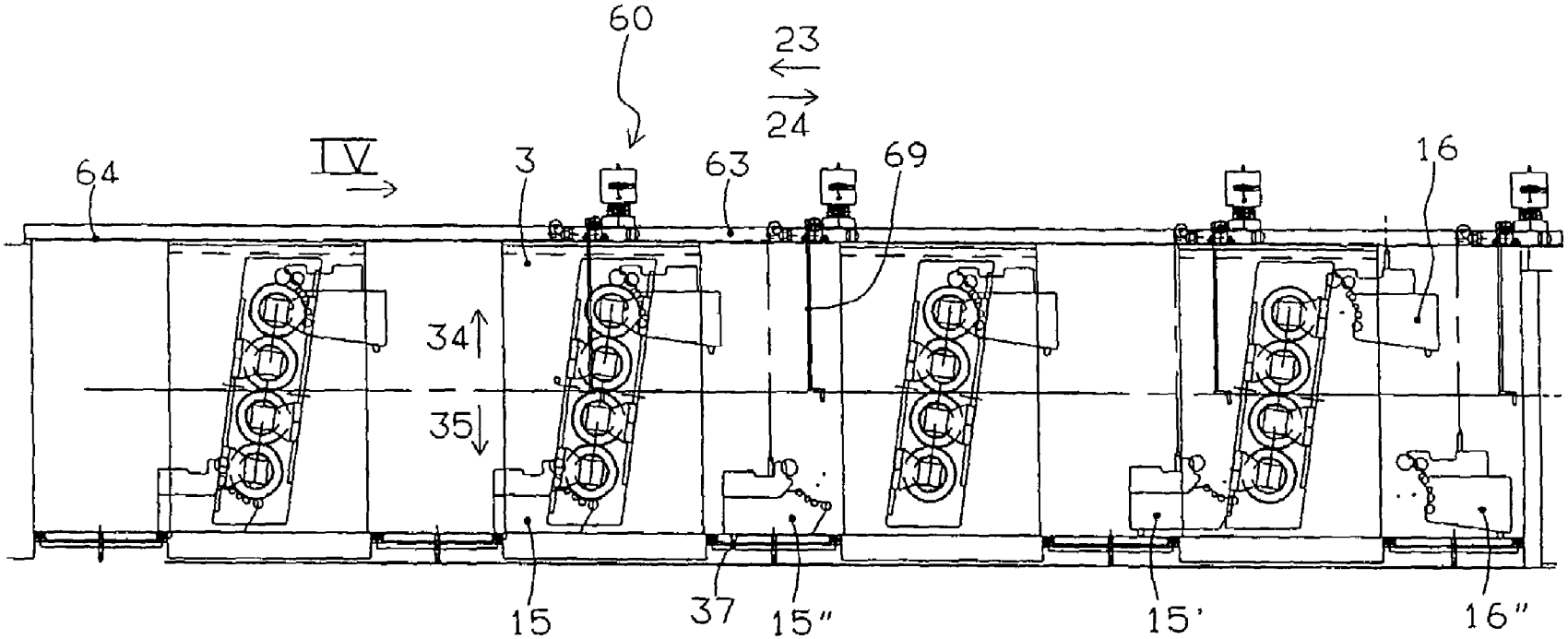
FIG. 9 is a side view similar to FIG. 2 of a further alternative embodiment of a printing machine according to the present invention.
Figure 10:
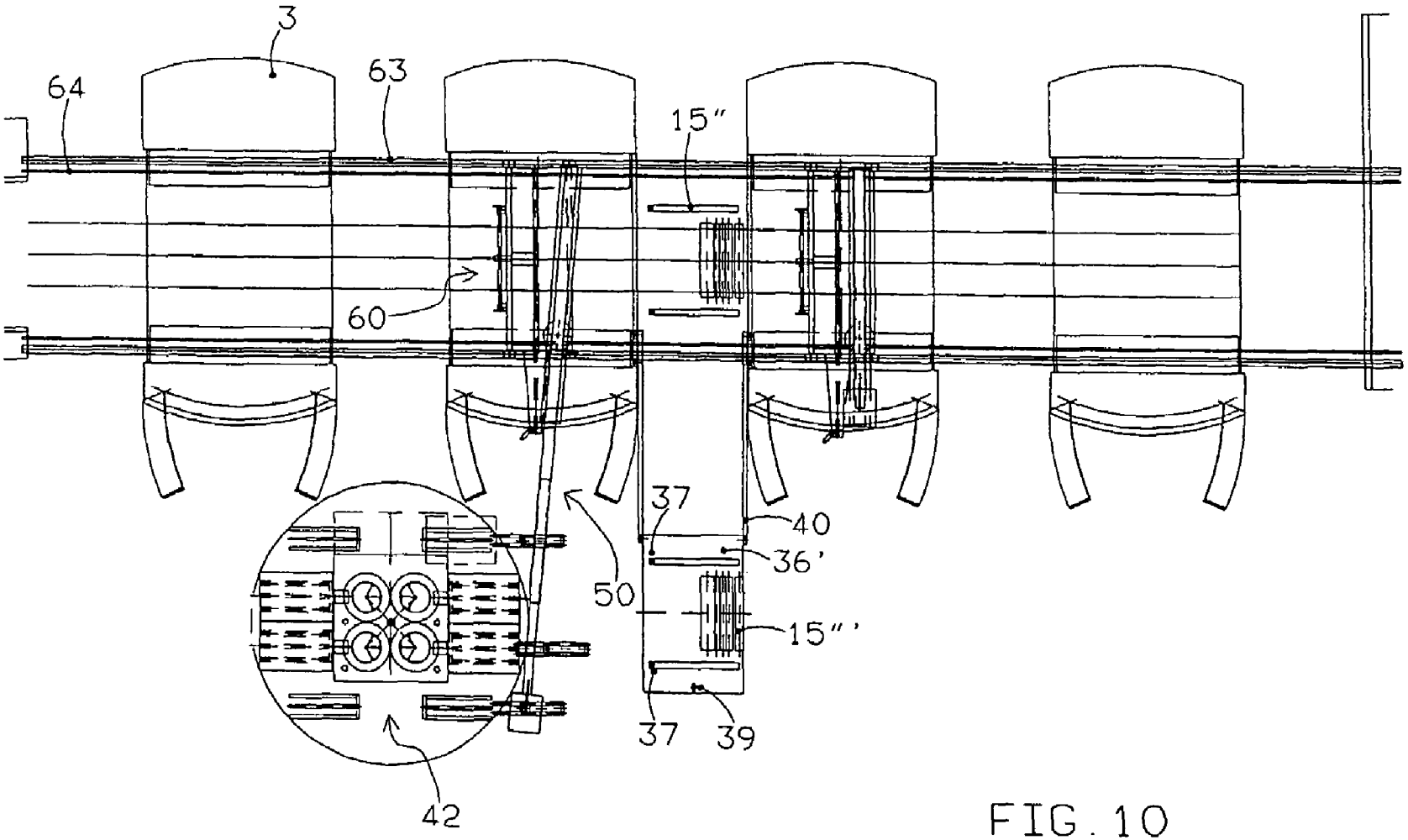
FIG. 10 is a top view of the printing machine of FIG. 9.

In the embodiment illustrated in FIGS. 4, 6 and 8, a lifting device 50 is rotatably or pivotably mounted on the top side 8 of each printing unit 3 via a centre of rotation 51. The lifting devices 50 have telescopically movable jibs 52, 53 and 54. An outer jib 52 is rotatably fastened to the top side 8 of a printing unit 3 via the center of rotation 51. Inner jibs 53 and 54 are nested one in the other and in the outer jib 52. The inner jibs are guided movably via rollers 55 and 56 (see FIG. 8). A relative movement between the jibs 53, 54 and 55 is therefore possible via the rollers 55 and 56. A winch 58 is mounted on a hook 57 on the innermost or foremost jib 54. A suspension device 41, which serves for transporting the printing sleeves 14, can, in turn, be suspended on a hook of the winch 58. With the embodiment of FIGS. 4, 6 and 8, only the printing sleeves 14 can be moved, and not the inking units. The lifting devices 50 are shown in different positions in FIG. 4. The position identified by the reference numeral 50' corresponds to a rest position of the lifting device 50. In the other illustrated positions of the lifting device, the jibs are extended telescopically and, if appropriate, pivoted about the center of rotation 51 or the corresponding rotary bearing.

A third exemplary embodiment of a printing machine according to the invention is shown in FIGS. 9–13. The embodiment of FIGS. 9–13 is to some extent a combination of the two exemplary embodiments described above. As with the earlier embodiments, only the differences from the previously described exemplary embodiments described are explained in detail. Therefore, identical reference numerals are used for the same subassemblies in order to avoid unnecessary repetition.

Figure 11:
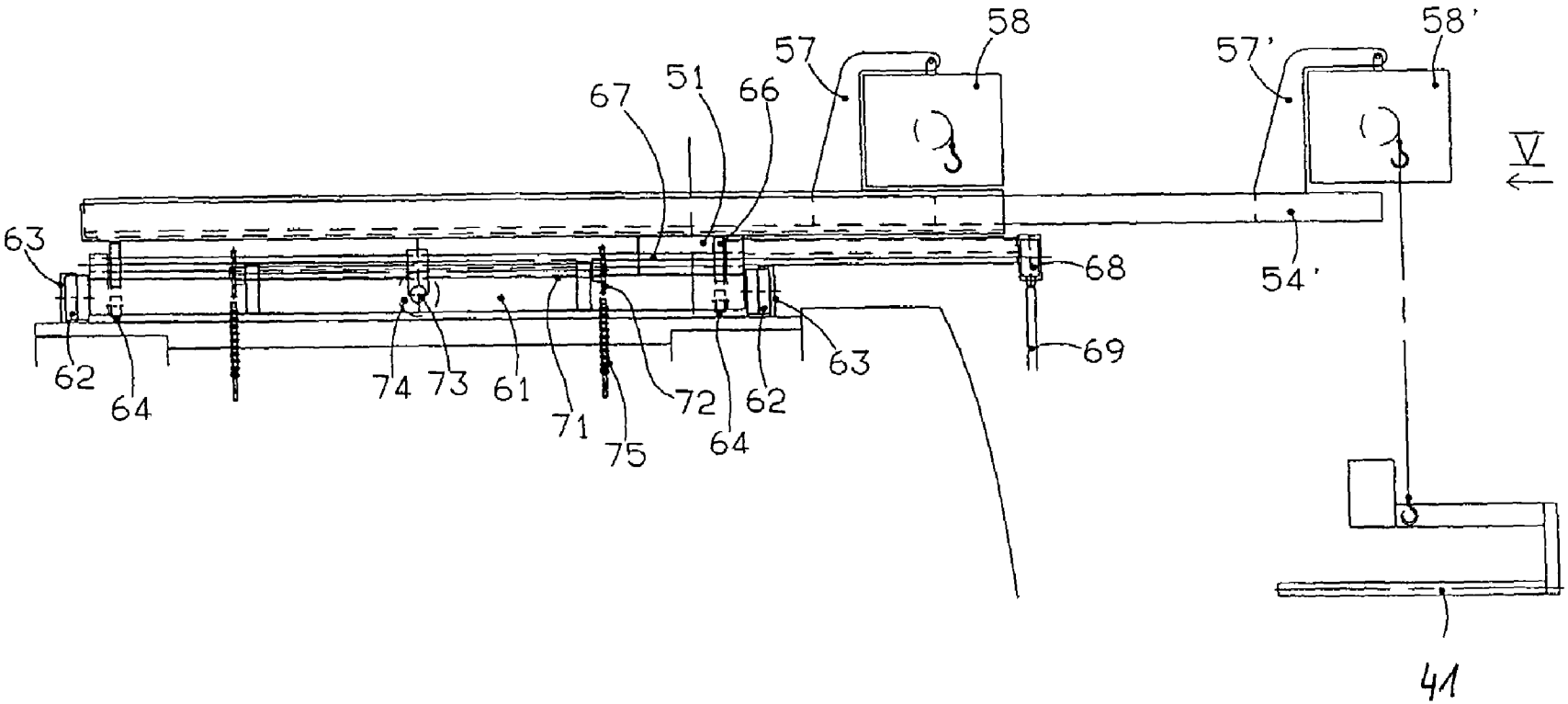
FIG. 11 is a view of the printing machine of FIG. 9 in the viewing direction IV of FIG. 9.
Figure 12:
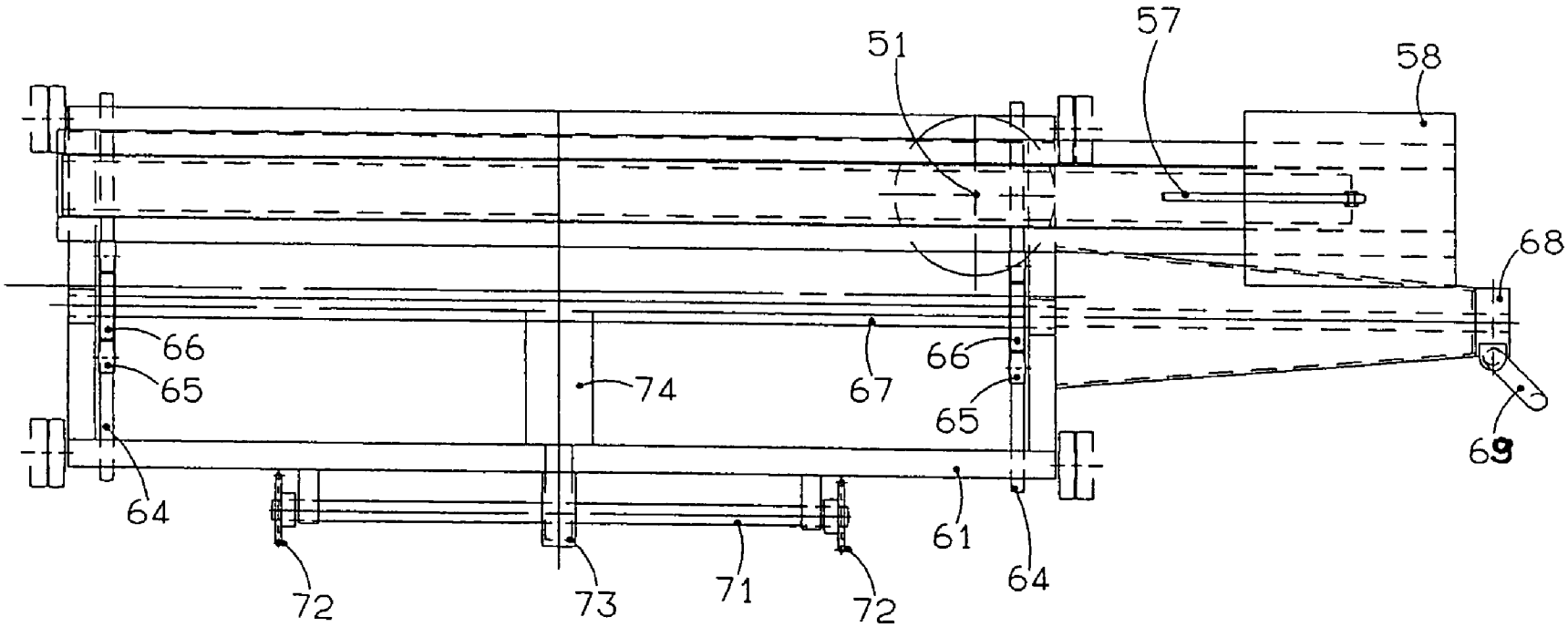
FIG. 12 is a top view of the printing machine of FIG. 9.
Figure 13:
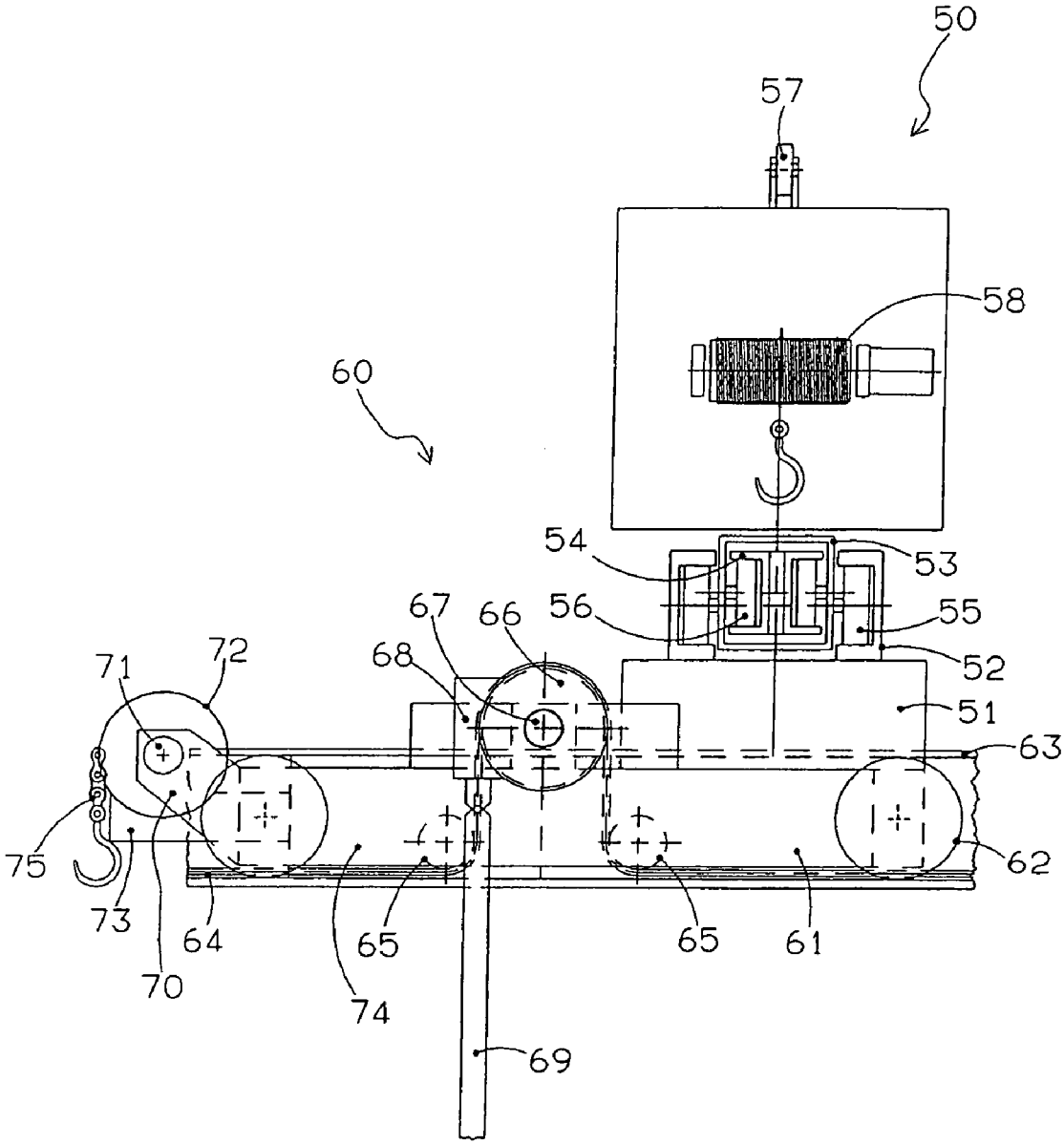
FIG. 13 is a view of the printing machine of FIG. 9 in the viewing direction V of FIG. 11.

In the embodiment of FIGS. 9–13, rails 63 are mounted on a top side 8 of the printing units 3. The rails 63 extend over the entire region of the printing units 3. Lifting devices 60 are displaceably or movably mounted on the rails 63. As shown in FIGS. 11 and 13, the lifting devices 60 have a frame 61. The frame 61 is guided movably in the rails 63 via rollers 62. The movement of the frame 61 along the rails 63 takes place, once again, via toothed belts 64. The toothed belts 64 are laid firmly on the top side 8 of the printing units 3 and are deflected via rollers 65 and drive rollers 66 (see FIG. 12). The drive rollers 66 are connected to one another by means of a shaft 67. A crank 69 engages on the shaft 67 via a gear 68. Thus, through actuation of the crank 69, the frame 61 and, in turn, the lifting device 60 can be moved along the rails 63.

As may be gathered shown in FIG. 13, the telescopically nested jibs 52, 53 and 54 are pivotably mounted on the frame 61 via a centre of rotation 51. As regards these details, the embodiment of FIGS. 9–13 corresponds to the embodiment of FIGS. 4, 6 and 8.

As shown in FIG. 13, bearing blocks 70 are fastened to the frame 61 of each of the lifting devices 60. A shaft 71 with chain wheels 72 is mounted in the bearing blocks. The shaft 71 is driven via a preferably self-locking gear 73 and a motor 74. The inking-unit modules 15 and 16 can be suspended on a chain 75 and moved, as described in connection with the embodiment of FIGS. 1, 2, 3, 5.

In this regard, mounting the crank 69 directly on the lifting device 60 enables a highly accurate movement of the lifting device 60 in the direction of the arrows 23 and 24 while at the same time enabling a visual check of the lifting operations and movement operations during the removal and installation of the printing-unit modules. This is particularly advantageous when only one printer carries out the conversion work or set-up work on the printing machine.

In terms of the invention, a combination of the drive via the toothed belt 64 with a crank 22 according to FIG. 2 is also advantageous. The toothed belt 64 would therefore not be laid firmly, but be drivable via a gear 21 and deflected via a shaft 20, as shown in FIG. 2. In such a case, the lifting device 60 could be moved quickly in the directions of the arrows 23 and 24 via the gear 61, in order to thereby move the lifting devices quickly into the position of use. An exact positioning or movement of the lifting device with a visual check under load would then be possible via the gear 68. The gear 21 would in this case have a ratio which is coordinated with a rapid movement of the lifting devices 60 without any load, and the gear 68 would have a ratio for a slow movement of the lifting devices 60 with a load.

List of Reference Symbols

| | |
|---|---|
| 1. | Printing machine |
| 2. | Reel changer |
| 3. | Printing unit |
| 4. | Dryer |
| 5. | Cooling unit |
| 6. | Cross cutter |
| 7. | Folding unit |
| 8. | Top side |
| 9. | Lifting device |
| 10. | Form cylinder |
| 11. | Form cylinder |
| 12. | Transfer cylinder |
| 13. | Transfer cylinder |
| 14. | Printing sleeve |
| 15. 15' 15" | Inking unit |
| 16. 16' 16" | Inking unit |
| 17. | Reel |
| 18. | Guide/rail |

-continued

| List of Reference Symbols | |
|---|---|
| 19. | Toothed belt |
| 20. | Transverse shaft |
| 21. | Gear |
| 22. | Crank |
| 23. | Arrow/direction of movement |
| 24. | Arrow/direction of movement |
| 25. | Frame |
| 26. | Support |
| 27. | Roller |
| 28. | Frame |
| 29. | Arrow/direction of movement |
| 30. | Arrow/direction of movement |
| 31. | Grip |
| 32. | Winch |
| 33. | Winch |
| 34. | Arrow/direction of movement |
| 35. | Arrow/direction of movement |
| 36. 36' | Platform |
| 37. | Guide pin |
| 38. | Roller |
| 39. | Roller |
| 40. | Guide/rail |
| 41. | Suspension device |
| 42. | Transport device |
| 43. | Depository |
| 44. | Suspension device |
| 45. | Beam |
| 46. | Loop |
| 47. | Pressure pin |
| 50. 50' | Lifting device |
| 51. | Center of rotation |
| 52. | Jib |
| 53. | Jib |
| 54. | Jib |
| 55. | Roller |
| 56. | Roller |
| 57. | Hook |
| 58. | Winch |
| 60. | Lifting device |
| 60. | Frame |
| 62. | Roller |
| 63. | Guide/rail |
| 64. | Toothed belt |
| 65. | Roller |
| 66. | Drive roller |
| 67. | Shaft |
| 68. | Gear |
| 69. | Crank |
| 70. | Bearing block |
| 71. | Shaft |
| 72. | Chain wheel |
| 73. | Gear |
| 74. | Motor |
| 75. | Chain |

The invention claimed is:

1. A web-fed printing machine comprising:

a plurality of printing units;

a first work station preceding the printing units;

a second work station following the printing units;

at least one lifting device assigned to the printing units for transporting printing unit modules for use with the printing units, said lifting device being movably mounted on a top side of the printing units, rails for the lifting device fastened on the top side of the printing units, said lifting device having a first frame guided in said rails by first rollers such that the lifting device can be moved in a first direction, and a second frame guided on the first frame by second rollers such that the lifting device can be moved in a second direction extending perpendicular to the first direction.

2. A web-fed printing machine comprising:

a plurality of printing units;

a first work station preceding the printing units;

a second work station following the printing units;

at least one lifting device assigned to the printing units for transporting printing unit modules for use with the printing units, said lifting device being movably mounted on a top side of the printing units via a center rotation, and said lifting device including telescopically movable jibs including an outer jib rotatably mounted on a printing unit via the centre of rotation and inner jibs nested one in the other and movably guided by rollers.

3. A web-fed printing machine comprising:

a plurality of printing units;

a first work station preceding the printing units;

a second work station following the printing units;

at least one lifting device assigned to the printing units for transporting printing unit modules for use with the printing units, said lifting device being movably mounted on a top side of the printing units, rails for the lifting device fastened on the top side of the printing units, said lifting device having a frame guided in the rails by first rollers such that the lifting device can be displaced in one direction, and said lifting device having telescopically movable jibs including an outer jib rotatably mounted on the frame by a center of rotation and innerjibs nested one in the other and movably guided via second rollers.

* * * * *